US010767658B2

(12) United States Patent
Ishida

(10) Patent No.: US 10,767,658 B2
(45) Date of Patent: Sep. 8, 2020

(54) AXIAL FAN AND REFRIGERATOR

(71) Applicant: Nidec Corporation, Kyoto (JP)

(72) Inventor: Ryosuke Ishida, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 229 days.

(21) Appl. No.: 15/791,452

(22) Filed: Oct. 24, 2017

(65) Prior Publication Data

US 2018/0135648 A1 May 17, 2018

(30) Foreign Application Priority Data

Nov. 11, 2016 (JP) ..... 2016-220592

(51) Int. Cl.

| | |
|---|---|
| ***F04D 29/52*** | (2006.01) |
| ***F04D 29/54*** | (2006.01) |
| ***F04D 19/00*** | (2006.01) |
| ***F04D 25/08*** | (2006.01) |

(52) U.S. Cl.

CPC ..... *F04D 29/522* (2013.01); *F04D 19/002* (2013.01); *F04D 25/08* (2013.01); *F04D 29/526* (2013.01); *F04D 29/545* (2013.01)

(58) Field of Classification Search

CPC .... F04D 29/526; F04D 29/522; F04D 29/545; F04D 25/08; F04D 19/002

USPC ..... 417/423.14, 424.1, 424.2

See application file for complete search history.

(56) References Cited

U.S. PATENT DOCUMENTS 5,489,186 A * 2/1996 Yapp ..... F01D 5/141 415/208.3
6,024,536 A * 2/2000 Tsubakida ..... B60H 1/00464 415/173.6
6,379,129 B1 4/2002 Obara
6,869,269 B2 * 3/2005 Huang ..... F04D 29/526 415/116
7,140,837 B2 * 11/2006 Ku ..... F04D 29/526 415/121.2
7,416,386 B2 * 8/2008 Ho ..... F04D 25/0613 361/695
9,051,942 B2 * 6/2015 Su ..... F04D 29/526
9,180,772 B2 * 11/2015 Durello ..... B60K 11/02

(Continued)

FOREIGN PATENT DOCUMENTS

CN 201027705 Y 2/2008
CN 201137594 Y 10/2008

(Continued)

OTHER PUBLICATIONS

Ishida et al., "Axial Fan and Refrigerator", U.S. Appl. No. 15/791,454, filed Oct. 24, 2017.

*Primary Examiner* — Christopher S Bobish
(74) *Attorney, Agent, or Firm* — Keating & Bennett, LLP

(57) ABSTRACT

An axial fan according to an exemplary embodiment of the present disclosure includes an impeller, a motor, and a housing. The impeller is configured to rotate about a rotation axis extending in a vertical direction. The motor is configured to rotationally drive the impeller. The housing is disposed radially outside the impeller and the motor. In a region overlapping in the vertical direction with the impeller, an inner wall surface of the housing includes at least one first wall having a narrow gap with a radially outer edge of the impeller and at least one second wall having a wide gap with the radially outer edge of the impeller.

14 Claims, 11 Drawing Sheets

(56) References Cited

U.S. PATENT DOCUMENTS

| | | | | |
|---|---|---|---|---|
| 9,745,987 | B2 | 8/2017 | Kobayashi et al. | |
| 9,938,989 | B2 * | 4/2018 | Vardar | F04D 25/0613 |
| 2006/0024160 | A1 * | 2/2006 | Horng | F04D 29/684 415/206 |
| 2006/0093499 | A1 * | 5/2006 | Horng | F04D 25/0613 417/423.1 |
| 2006/0216147 | A1 * | 9/2006 | Park | F04D 29/164 415/220 |
| 2007/0140844 | A1 | 6/2007 | Yoshida | |
| 2007/0242430 | A1 * | 10/2007 | Liu | F04D 25/0613 361/695 |
| 2008/0225480 | A1 | 9/2008 | Kayama et al. | |
| 2008/0232961 | A1 * | 9/2008 | Lin | F04D 17/025 415/213.1 |
| 2009/0162203 | A1 | 6/2009 | Yoo et al. | |
| 2013/0136591 | A1 | 5/2013 | Yen et al. | |
| 2017/0211589 | A1 * | 7/2017 | Murakami | F04D 19/002 |
| 2017/0350412 | A1 * | 12/2017 | Hioki | F04D 29/164 |
| 2018/0231024 | A1 * | 8/2018 | Guo | F04D 25/06 |

FOREIGN PATENT DOCUMENTS

| | | | |
|---|---|---|---|
| CN | 100582496 | C | 1/2010 |
| JP | 2001-263288 | A | 9/2001 |
| KR | 10-2008-0083564 | A | 9/2008 |
| KR | 10-2009-0069027 | A | 6/2009 |
| WO | 03/089858 | A1 | 10/2003 |

* cited by examiner

AXIAL FAN AND REFRIGERATOR

CROSS REFERENCE TO RELATED APPLICATIONS

This application claims the benefit of priority to Japanese Patent Application No. 2016-220592 filed on Nov. 11, 2016. The entire contents of this application are hereby incorporated herein by reference.

BACKGROUND OF THE INVENTION

1. Field of the Invention

The present disclosure relates to axial fans and refrigerators.

2. Description of the Related Art

Various structures of axial fans have been proposed in the related art. For example, Japanese Unexamined Patent Application Publication No. 2013-113128 discloses the following structure of an axial fan.

The axial fan disclosed in Japanese Unexamined Patent Application Publication No. 2013-113128 includes an impeller and a casing surrounding the outer circumference in the radial direction of the impeller and including an intake port and an ejection port. The inner surface of the casing includes an intake-side inclined portion in which the intake port expands outward in the radial direction of the impeller. The inner surface of the casing also includes an ejection-side inclined portion in which the ejection port expands outward in the radial direction of the impeller.

The axial fan disclosed in Japanese Unexamined Patent Application Publication No. 2013-113128 is capable of increasing the blast volume by drawing fluid around the intake port using the intake-side inclined portion. Furthermore, the axial fan disclosed in Japanese Unexamined Patent Application Publication No. 2013-113128 smoothly guides a discharge flow along the ejection-side inclined portion. This reduces or eliminates generation of a turbulent flow, allowing a large static pressure to be obtained.

In the case where the axial fan is mounted in a refrigerator or the like, there is a case where the wind direction has to be adjusted depending on the specification of the air flow channel in the apparatus. However, it is not easy for the axial fan disclosed in Japanese Unexamined Patent Application Publication No. 2013-113128 to adjust the wind direction.

SUMMARY OF THE INVENTION

An axial fan according to an exemplary embodiment of the present disclosure includes an impeller configured to rotate about a rotation axis extending in a vertical direction, a motor configured to rotationally drive the impeller, and a housing disposed radially outside the impeller and the motor. In a region overlapping in the vertical direction with the impeller, an inner wall surface of the housing includes at least one first wall having a narrow gap with a radially outer edge of the impeller and at least one second wall having a wide gap with the radially outer edge of the impeller.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
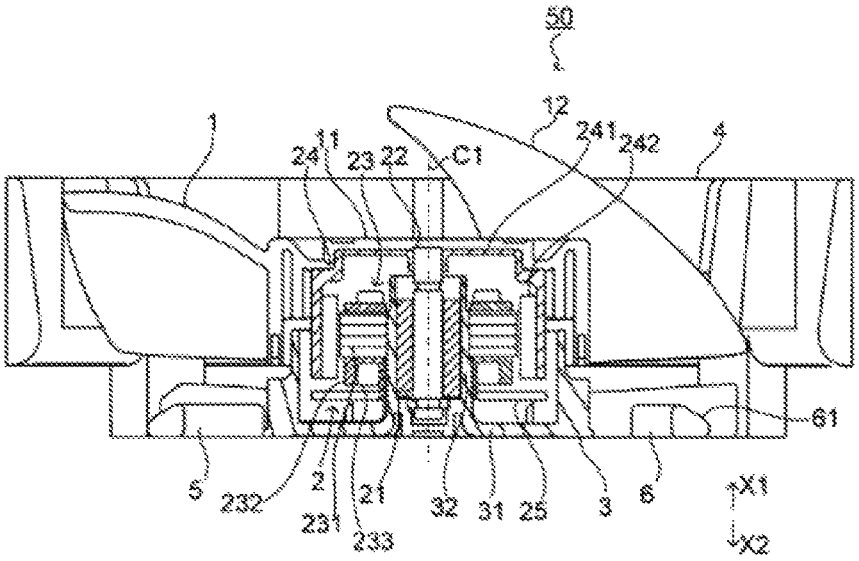
FIG. 1 is a longitudinal sectional view of an axial fan according to a first embodiment of the present disclosure.

Exemplary embodiments of the present disclosure will be described hereinbelow with reference to the drawings. In the following description on the configurations of axial fans, a direction in which the rotation axis of an impeller is referred to as "vertical direction". A radial direction around the rotation axis is simply referred to as "radial direction", and a circumferential direction around the rotation axis is simply referred to as "circumferential direction". However, the vertical direction does not indicate a positional relationship and a direction when the axial fan is installed in an actual apparatus. In the drawings, the upper side is denoted by X1, and the lower side is denoted by X2.

Figure 2:
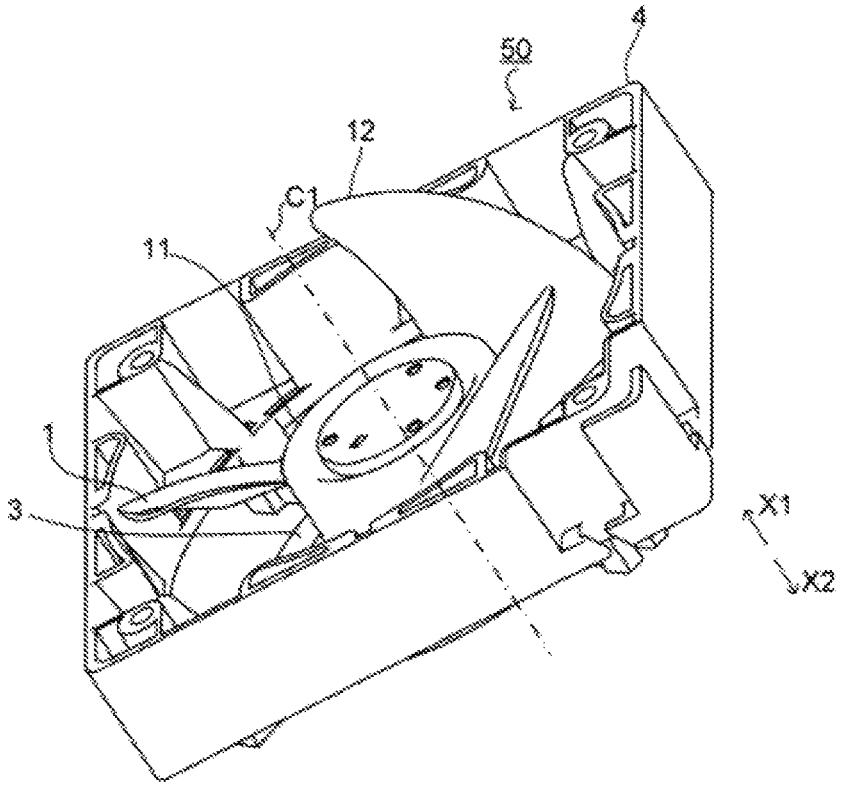
FIG. 2 is a perspective view of the axial fan according to the first embodiment of the present disclosure viewed from above.
Figure 3:
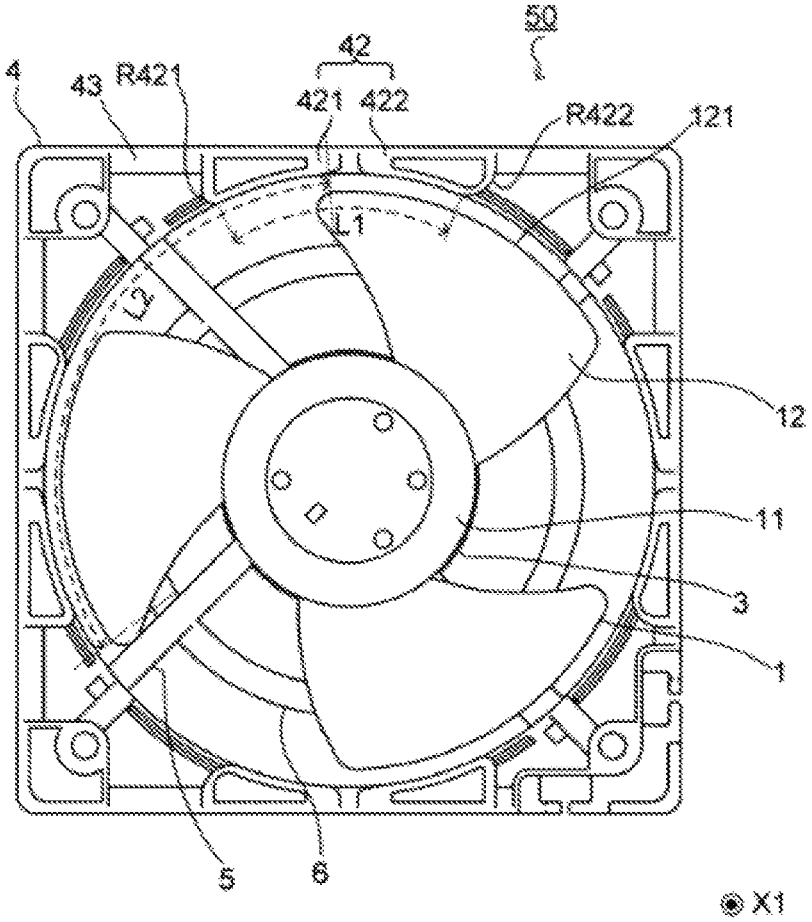
FIG. 3 is a plan view of the axial fan according to the first embodiment of the present disclosure viewed from above.
Figure 4:
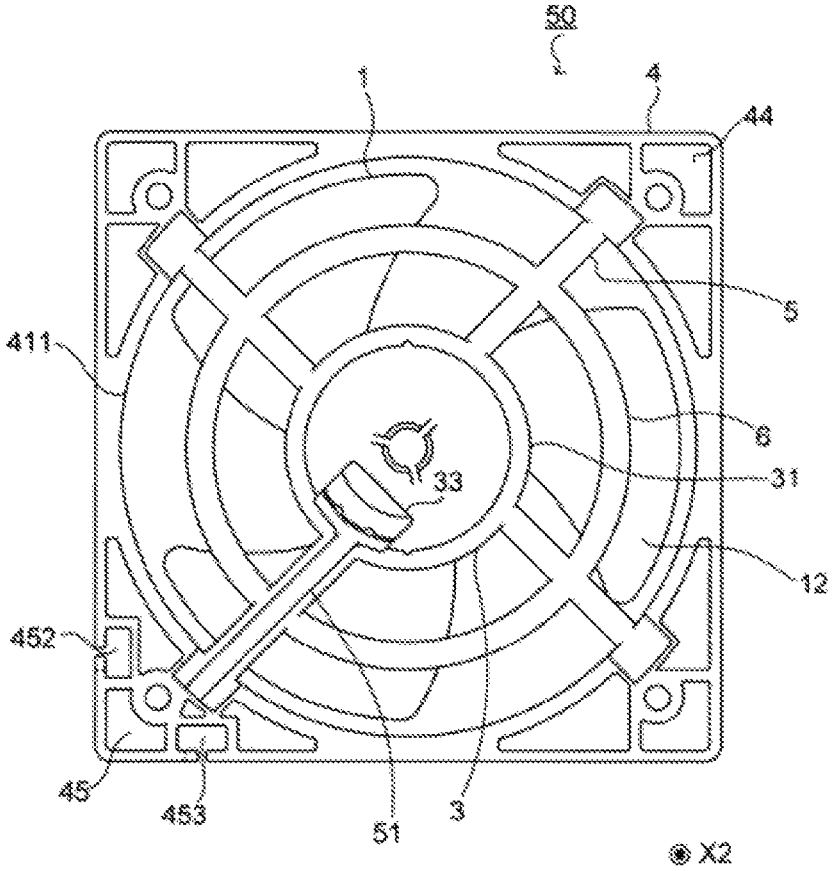
FIG. 4 is a plan view of the axial fan according to the first embodiment of the present disclosure viewed from below.

First, the overall configuration of an axial fan according to a first embodiment of the present disclosure will be described with reference to FIGS. 1 to 4. FIG. 1 is a longitudinal sectional view of an axial fan 50 according to the first embodiment of the present disclosure. FIG. 2 is a perspective view of the axial fan 50 viewed from above. FIG. 3 is a plan view of the axial fan 50 viewed from above. FIG. 4 is a plan view of the axial fan 50 viewed from below.

The axial fan 50 includes an impeller 1, a motor 2, a motor base unit 3, a housing 4, ribs 5, and a ring-shaped rib 6.

The motor base unit 3, the housing 4, the ribs 5, and the ring-shaped rib 6 are formed of the same resin material. The housing 4 houses the impeller 1 and the motor 2 and is disposed radially outside the impeller 1 and the motor 2.

The motor 2 rotationally drives the impeller 1 about a rotation axis C1. The motor 2 includes a bearing portion 21, a shaft 22, a stator 23, a rotor 24, and a circuit board 25.

The motor base unit 3 supports the motor 2. The motor base unit 3 includes a base 31 extending in the radial direction on the lower surface side and a bearing holding portion 32 protruding upward from the center of the base 31. The bearing holding portion 32 holds the cylindrical bearing portion 21 therein. The bearing portion 21 includes a sleeve bearing. The bearing portion 21 may include a pair of ball bearings disposed vertically.

The shaft 22 is a columnar member extending in the vertical direction and is formed of metal, such as stainless steel. The bearing portion 21 rotatably holds the shaft 22 about the rotation axis C1.

The stator 23 is fixed to the outer circumferential surface of the bearing holding portion 32. The stator 23 includes a stator core 231, an insulator 232, and a coil 233. The stator core 231 includes a laminated steel plate in which electromagnetic steel sheets, such as silicon steel sheets, are laminated in the vertical direction. The insulator 232 is formed of insulating resin. The coil 233 is wound around the stator core 232 in the vertical direction, with the insulator 232 therebetween.

The circuit board 25 is disposed below the stator core 232. The circuit board 25 is a substrate on which an electronic circuit for applying a driving current to the coil 233 is mounted. The lead wire of the coil 233 is electrically connected to the circuit board 25.

The rotor 24 includes a rotor yoke 241 and a magnet 242. The rotor yoke 241 is a substantially cylindrical member having a cover on the top and is formed of a magnetic material. The rotor yoke 241 is fixed to the shaft 22. The cylindrical magnet 242 is fixed to the inner circumferential surface of the rotor yoke 241. The magnet 242 is disposed radially outside the stator 23. The N-pole and the S-pole are alternately arranged in the circumferential direction on the pole face of the magnet 242. A magnetic circuit is formed between the rotor yoke 241 and the magnet 242. This reduces leakage of magnetic flux from the magnet 242 to the outside of the axial fan 50.

The impeller 1 includes an impeller cup 11 and a plurality of blades 12 and is formed of a resin material. The impeller cup 11 is a substantially cylindrical member having a cover on the top. The rotor yoke 241 is fixed to the inside of the impeller cup 11. The plurality of blades 12 are formed radially outside the impeller cup 1. In the present embodiment, three blades 12 are disposed at regular intervals in the circumferential direction, as illustrated in FIG. 3, by way of example.

In the thus-configured axial fan 50, when a driving current is applied to the coil 233 of the stator 23, a magnetic flux in the radial direction is generated in the stator core 231. The magnetic flux between the stator core 231 and the magnet 242 causes a circumferential torque. This causes a rotary unit including the rotor 24 and the impeller 1 to rotate about the rotation axis C1. The impeller 1 rotates counterclockwise in the top view of FIG. 3.

When the impeller 1 rotates, an air current is generated by the plurality of blades 12. In other words, an air current in which the upper side of the axial fan 50 is on the air intake side and the lower side is on the exhaust side is generated to allow blowing.

Figure 5:
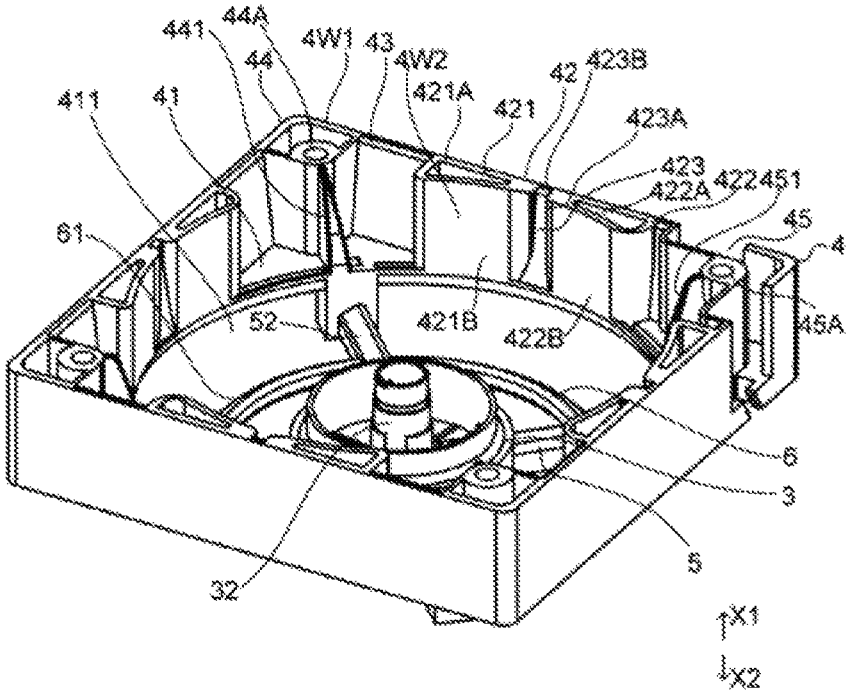
FIG. 5 is a perspective view of a housing according to the first embodiment of the present disclosure viewed from above.
Figure 6:
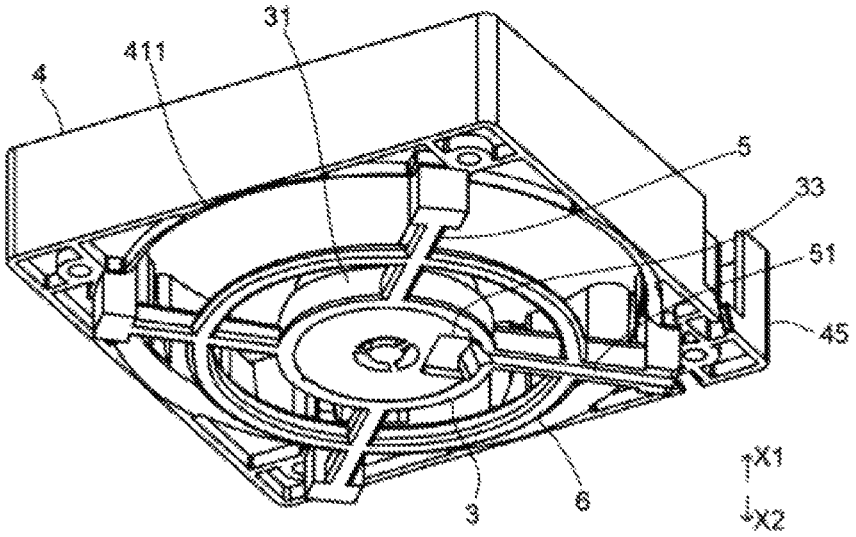
FIG. 6 is a perspective view of the housing according to the first embodiment of the present disclosure viewed from below.

Next, the configuration of the housing 4 will be described in detail. FIG. 5 is a perspective view of the housing 4 viewed from above. FIG. 6 is a perspective view of the housing 4 viewed from below.

The housing 4 includes a bottom plate 41 at the lower part. The bottom plate 41 includes a vent 411 which is a circular opening.

An outer wall surface 4W1 of the housing 4 extends upward from the outer edge of the bottom plate 41 and has a substantially square shape in a cross-sectional view perpendicular to the vertical direction. The outer wall surface 4W1 may have a shape other than the square shape, such as a rectangular shape. An inner wall surface 4W2 is disposed inside the outer wall surface 4W1. The four sides of the inner wall surface 4W2 each have a thick-wall portion 42 and thin-wall portions 43. The thick-wall portion corresponds to a first wall, and the thin-wall portions 43 correspond to a second wall.

The thick-wall portion 42 is disposed in the center of one side of the inner wall surface 4W2. The thick-wall portion 42 includes a pair of first thick-wall portion 421 and second thick-wall portion 422. The first thick-wall portion 421 and the second thick-wall portion 422 are disposed adjacent to each other along one side of the inner wall surface 4W2.

The first thick-wall portion 421 and the second thick-wall portion 422 are each formed of a wall extending upward from the bottom plate 41. The wall has a closed shape in a cross-sectional view perpendicular to the vertical direction. Thus, the first thick-wall portion 421 and the second thick-wall portion 422 respectively have cavities 421A and 422A inside thereof. These cavities 421A and 422A reduce or eliminate generation of sink marks during molding of the housing 4 using a mold.

The first thick-wall portion 421 and the second thick-wall portion 422 are both formed from the bottom plate 41 to the upper end of the housing 4 and overlap in the vertical position with the impeller 1. An inner surface 421B of the first thick-wall portion 421 and an inner surface 422B of the second thick-wall portion 422 both constitute part of the substantial cylindrical shape centered on the rotation axis C1. The thick-wall portion 42 has a groove 423 (described later) disposed between the first thick-wall portion 421 and the second thick-wall portion 422.

The thin-wall portions 43 are disposed on both sides of the thick-wall portion 42. In other words, the thin-wall portions 43 are disposed at positions nearer to the four corners of the inner wall surface 4W2 than the thick-wall portion 42. The gap between the radially outer edge 121 (see FIG. 3) of each blade 12 of the impeller 1 and the thick-wall portion 42 is smaller than the gap between the radially outer edge 121 and the thin-wall portions 43.

Figure 7:
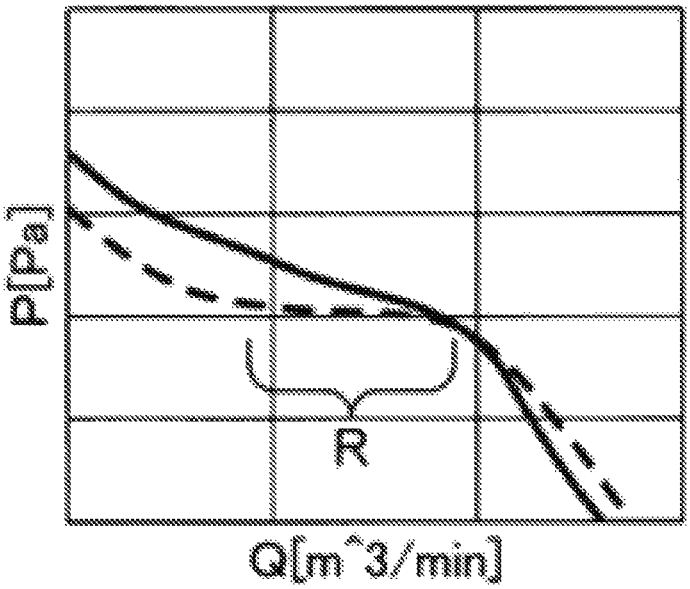
FIG. 7 is a graph illustrating an example of the P-Q characteristics ([static pressure (P)/quantity (Q)] characteristics) of the axial fan according to the first embodiment of the present disclosure and an axial fan according to a comparative example.

FIG. 7 is a graph illustrating an example of the P-Q characteristics ([static pressure (P)/quantity (Q)] characteristics) of the axial fan 50 according to the present embodiment and an axial fan according to a comparative example. In FIG. 7, the solid line indicates the present embodiment, and the broken line indicates the comparative example. The comparative example has a configuration in which the housing of the axial fan 50 according to the present embodiment does not include the thick-wall portion 42 and the thin-wall portions 43. In other words, the thicknesses of the walls of the four sides of the housing are constant in a direction in which the sides extend.

As shown in FIG. 7, the present embodiment has a higher static pressure in a low air-volume region than the comparative example because of the configuration of the thick-wall portion 42 and the thin-wall portions 43. The comparative example has a surge region R in which the static pressure does not change with respect to the blast volume, causing unstable blowing. In contrast, the present embodiment allows region corresponding to such a surge region to be a region in which the static pressure changes with respect to the blast volume, allowing stable blowing.

Furthermore, in the present embodiment, exhaust air exhausted downward through the vent 411 of the housing 4 flows directly below in the vicinity of the thick-wall portion 42, whereas in the vicinity of the thin-wall portions 43, the exhaust air flows relatively outward in the radial direction. Thus, the direction of the exhaust flow can be adjusted by the design of the thick-wall portion 42 and the thin-wall portions 43.

Providing the thick-wall portion 42 increases the rigidity of the housing 4, thereby reducing or eliminating vibrations generated when the axial fan 50 is in operation.

Furthermore, since the inner surface 421B of the first thick-wall portion 421 and the inner surface 422B of the second thick-wall portion 422 constitute part of the substantial cylindrical shape centered on the rotation axis C1, the gap between the radially outer edge 121 of each blade 12 and the thick-wall portion 42 is decreased to improve the static pressure. Furthermore, generation of noise can be reduced or eliminated by decreasing a turbulent flow.

As illustrated in FIG. 3, in the present embodiment, a circumferential length L1 between one end of the first thick-wall portion 421 and one end of the second thick-wall portion 422 is smaller than a distance L2 between forward ends of the radially outer edge 121 in the rotational direction of adjacent blades 12. This prevents the adjacent blades 12 from crossing both ends of the thick-wall portion 42 at the same time, thereby reducing or eliminating generation of noise. Even if the length L1 is larger than the distance L2, the same effect is exerted.

The number of the thick-wall portions 42 is four, whereas the number of the blades 12 is three, and the numbers are prime to each other. Furthermore, both the thick-wall portions 42 and the blades 12 are disposed at regular intervals in the circumferential direction. This prevents the three blades 12 from crossing the thick-wall portions 42 at the same time, thereby reducing or eliminating generation of noise. The number of the thick-wall portions and the number of the blades may be other than the above provided that they are prime to each other.

All of the circumferential lengths L1 of the four thick-wall portions 42 are set equal. This makes the static pressure distribution symmetrical about the rotation axis, thereby reducing generation of a turbulent flow.

Both circumferential ends of the thick-wall portion 42 are disposed on the inner wall surface 4W2 of the same side. This increases the rigidity of the housing 4.

As illustrated in FIG. 3, a rounded portion R422 at a circumferential end of the second thick-wall portion 422 has a lager diameter than the diameter of a rounded portion R421 at a circumferential end of the first thick-wall portion 421. In other words, the rounded portion of the circumferential end of the second thick-wall portion 422 that the blade 12 crosses first is formed large. This reduces or eliminates generation of noise. In the above configuration, the first thick-wall portion 421 and the second thick-wall portion 422 are asymmetrical. Alternatively, they may be line-symmetrical.

The area of the inner surface of the thick-wall portion 42 facing the blades 12 in the radial direction affects the static pressure. Therefore, if the same area is secured, the thick-wall portion 42 can also be disposed off the center of one side of the inner wall surface 4W2.

The thick-wall portion 42 may not be provided on all of the four sides of the inner wall surface 4W2. For example, the thick-wall portion 42 may not be provided on opposing two sides of the four sides, and a thick-wall portion 42 having a larger circumferential length may be provided on the remaining two sides to improve the static pressure.

The thick-wall portion 42 may not be formed of two thick-wall portions as in the above. For example, the thick-wall portion 42 may be formed of three thick-wall portions. In this case, the groove 423 (described later) may be formed at a position between the thick-wall portions. In other words, two grooves 423 are provided.

In the present embodiment, as illustrated in FIGS. 4 and 5, first fixing portions 44 are provided at three corners of the housing 4, and a second fixing portion 45 is provided at the remaining one corner. The first fixing portions 44 and the second fixing portion 45 are used to fix the housing 4 to an apparatus. The first fixing portions 44 extend upward from the bottom plate 41 and each include a portion having a through-hole 44A for screw fixing and a projecting rib 441 projecting radially inward from a corner of the portion. The second fixing portion 45 extends upward from the bottom plate 41 and includes a portion having a through-hole 45A for screw fixing and a projecting rib 451 projecting radially inward from a corner of the portion. Unlike the first fixing portions 44, the second fixing portion 45 includes a first hole 452 and a second hole 453 formed in the bottom plate 41.

The gap between the projecting ribs 441 and 451 and the blades 12 is small. This improves the static pressure. This also improves the rigidity of the corners of the housing 4. However, since the present embodiment is configured to improve the static pressure with the thick-wall portions 42, the projecting ribs 441 and 451 described above are not absolutely necessary. Without the projecting ribs 441 and 451, noise can be reduced.

A configuration for drainage provided in the housing 4 of the present embodiment will be described in detail. The thick-wall portion 42 described above has the groove 423 for drainage between the first thick-wall portion 421 and the second thick-wall portion 422.

The groove 423 is recessed radially outward and extends in the vertical direction. The upper end of the groove 423 extends to the upper end of the housing 4. This allows moisture adhering to the inner wall surface 4W2 to be collected into the groove 423 and to be discharged through the upper end of the housing 4.

The groove 423 radially faces each blade 12 of the impeller 1. This allows moisture collected to a portion of the groove 423 facing the blade 12 to be discharged. For example, in the case where the axial fan is applied to a cold environment, such as a refrigerator, even if moisture adheres to the inner wall surface 4W2 of the housing 4, a sufficient gap can be provided between the inner wall surface 4W2 of the housing 4 inner wall surface and the impeller 1.

The groove 423 increases in depth in the entire vertical direction toward the upper end of the housing 4. This allows the moisture collected to the groove 423 to be guided upward for drainage. The depth of the groove 423 may be constant partly in the vertical direction.

An end of the groove 423 extending to the upper end of the housing 4 is disposed on the air intake side. If the end of the groove extending to the end of the housing 4 is disposed at the exhaust side, the moisture is diffused widely far away by the discharged air. However, the above configuration avoids such diffusion.

The groove 423 has vertically extending edges 423A positioned on both sides of the groove 423 in the circumferential direction and connected to the inner wall surface 4W2. The edges 423A are rounded. In other words, the edges 423A are curved. This makes it easy to guide moisture adhering to the inner wall surface 4W2 into the groove 423.

Furthermore, the end of the groove 423 at the upper end of the housing 4 has an edge 423B. The edge 423B is rounded. In other words, the edge 423B is curved. This makes it easy to efficiently discharge the moisture collected in the groove 423.

Only the lower end of the groove 423 may extend to the lower end of the housing 4, or alternatively, the upper and lower ends of the groove 423 may extend to the upper and lower ends of the housing 4, respectively.

The thin-wall portions 43 are inclined so as to decrease in thickness toward the above. In other words, the gap between the thin-wall portions 43 and the blades 12 increases toward the above. This allows moisture adhering to the thin-wall portions 43 to be guided upward for drainage.

The motor base unit 3 is disposed in the center of the vent 411. Four ribs 5 are formed in such a manner as to extend from the outer circumferential surface of the base 31 of the motor base unit 3 toward the four corners of the housing 4. The ribs 5 connect the lower surface of the bottom plate 41 and the outer circumferential surface of the base 31. Providing the ribs 5 improves the rigidity of the axial fan 50.

As illustrated in FIG. 4, of the four ribs 5, the rib 5 extending toward the second fixing portion 45 has a recess 51 that is recessed upward from the lower surface. A through-hole 33 is formed in the lower surface of the base 31. The through-hole 33 and the recess 51 are connected.

A cable (not shown) that is electrically connected to the circuit board 25 is passed through the through-hole 33 from above to below, is routed in the recess 51, is passed through the second hole 453 from below to above, and is then passed through the first hole 452 from above to below.

As illustrated in FIG. 5, the upper surface of each rib 5 has an inclined surface 52 that is inclined downward toward the forward end of the impeller 1 in the rotating direction. This allows an air current to be guided downward along the inclined surface 52.

The ring-shaped rib 6 connects the four ribs 5 to form a ring shape centered on the rotation axis C1. As illustrated in FIG. 5, the upper surface of the ring-shaped rib 6 has an inclined surface 61 that is inclined radially outward. This allows an air current to be guided radially outward along the inclined surface 61.

Figure 8:
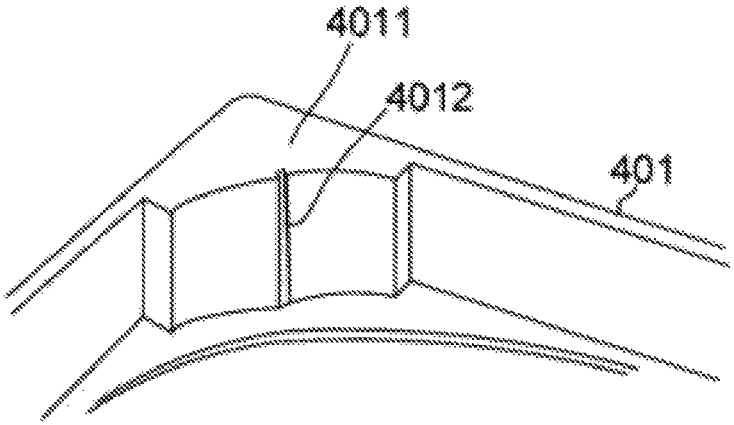
FIG. 8 is a partial perspective view of a housing of an axial fan according to a second embodiment of the present disclosure.

Next, a second embodiment, which is a modification of the first embodiment, will be described. FIG. 8 is a partial perspective view of a housing 401 of an axial fan according to the second embodiment of the present disclosure.

The housing 401 has not the thick-wall portion 42 in the center of each side of the inner wall surface, as in the first embodiment, but has a thick-wall portion 4011 at each of the corners of the rectangular shape.

The inner surfaces of the thick-wall portions 4011 constitute part of a cylinder centered on the rotation axis. In other words, both circumferential ends of each thick-wall portion 4011 are disposed on the inner wall surfaces of different sides of the rectangular shape.

Thus, the thick-wall portion is not provided on the inner wall surface of each side. This allows the radially outer edge of the impeller to be extended toward the inner wall surface, allowing the diameter of the impeller to be increased. This improves the rigidity of the housing 401 and the static pressure as in the first embodiment.

Each thick-wall portion 4011 has a groove 4012 in the circumferential center of the inner surface. The groove 4012 may have a configuration similar to that of the groove 423 of the first embodiment and exerts a drainage effect similar to that in the first embodiment.

Figure 9:
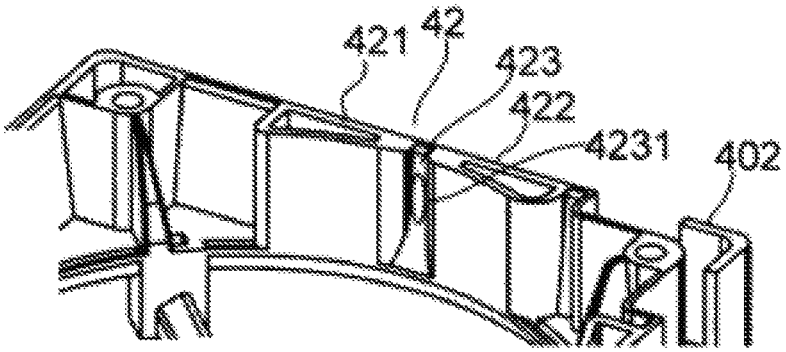
FIG. 9 is a partial perspective view of a housing of an axial fan according to a third embodiment of the present disclosure.

FIG. 9 is a partial perspective view of a housing 402 of an axial fan according to a third embodiment of the present disclosure. The housing 402 has a hole 4231 in the groove 423, which is a configuration difference from the housing 4 according to the first embodiment. The hole 4231 is disposed at the bottom of the groove 423 and passes through the housing 402 in the radial direction.

This allows moisture adhering to the inner wall surface of the housing 402 and collected into the groove 423 to be discharged through the hole 4231.

The hole 4231 is opposed to part of the blade of the impeller in the radial direction. This ensures a sufficient gap between the housing inner wall surface and the impeller even if moisture adheres to the housing inner wall surface.

A radially inside edge (an edge connecting to the bottom of the groove 423) of the hole 4231 is rounded. This makes it easy to guide moisture collected in the groove 423 into the hole 4231.

Figure 10:
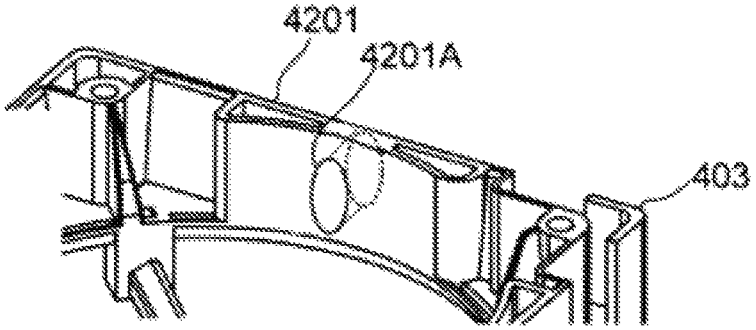
FIG. 10 is a partial perspective view of a housing of an axial fan according to a fourth embodiment of the present disclosure.

FIG. 10 is a partial perspective view of a housing 403 of an axial fan according to a fourth embodiment of the present disclosure. The housing 403 includes a thick-wall portion 4201 disposed on each side of the inner wall surface, which is a configuration difference from the housing 4 according to the first embodiment.

The thick-wall portion 4201 does not include a plurality of thick-wall portions and grooves unlike the first embodiment. The inner surface of the thick-wall portion 4201 constitutes part of a cylinder centered on the rotation axis. The thick-wall portion 4201 has a hole 4201A passing through the housing 403 in the radial direction at the circumferential center of the inner surface. The configuration of the hole 4201A may be the same as the configuration of the hole 4231 of the third embodiment.

The hole 4201A also allows moisture adhering to the inner wall surface of the housing 403 to be discharged.

Figure 11:
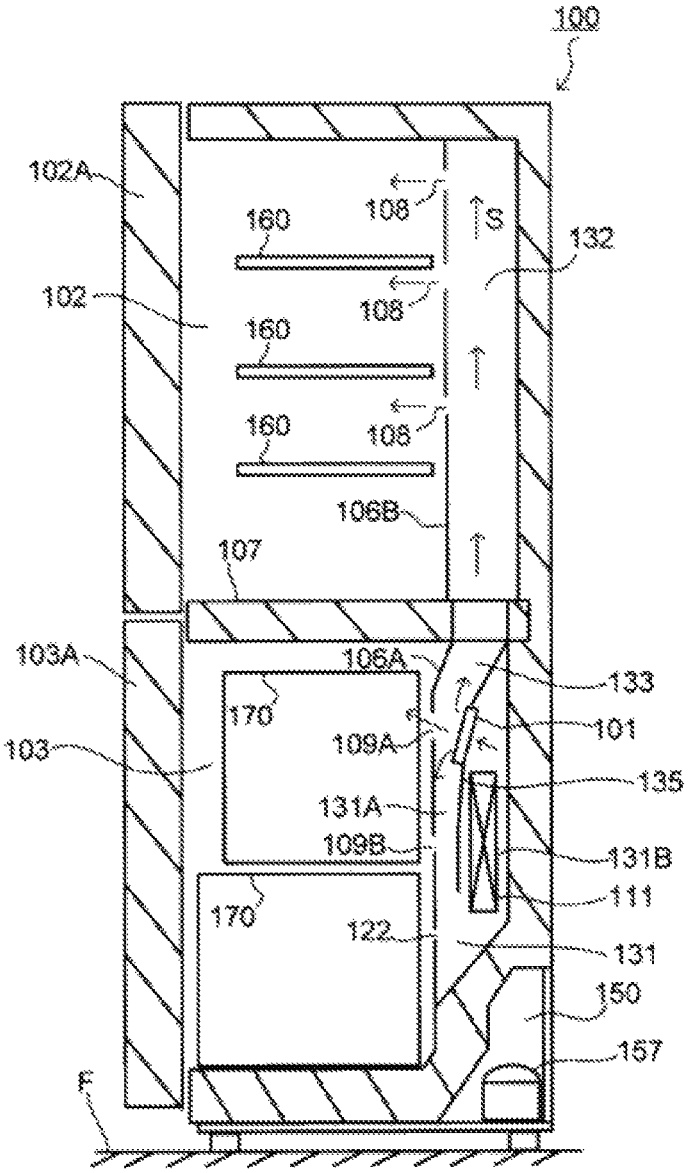
FIG. 11 is a side sectional view of a refrigerator including an axial fan according to an embodiment of the present disclosure.

Next, a case where an axial fan according to one of the above embodiments is used in a refrigerator, which is an example application, will be described. FIG. 11 is a side sectional view of a refrigerator 100 including an axial fan 101 according to an embodiment of the present disclosure. Arrow S indicates the flow of cold air. The refrigerator 100 is installed on a floor surface F. A refrigerating compartment 102 (a storage room), which is opened and closed by a door 102A, is disposed at the upper part of the refrigerator 100. A freezer 103 (a storage room), which is opened and closed by a door 103A, is disposed at the lower part of the refrigerator 100.

The refrigerating compartment 102 is kept at a refrigeration temperature (for example, 3° C.) to refrigerate stored items. The refrigerating compartment 102 includes a plurality of trays 160 on which stored items are to be placed. The door 102A of the refrigerating compartment 102 includes a plurality of storage pockets (not shown).

The freezer 103 is isolated from the refrigerating compartment 102 by an adiabatic wall 107 and is kept at a freezing point or below to keep stored items frozen. The freezer 103 includes a plurality of storage cases 170 for storing stored items. The storage case 170 is supported by rails (not shown) provided on both side walls of the freezer 103 so as to be movable in the front-to-back direction.

A machine room 150 is provided on the back of the freezer 103. A compressor 157 is disposed in the machine room 150. The compressor 157 connects to a condenser, an expander (both are not shown), and a cooler 111. When the compressor 157 is driven, a refrigerant, such as isobutane, circulates to operate a refrigeration cycle. This brings the cooler 111 to the low temperature side of the refrigeration cycle.

A cold air passage 131 partitioned by a back plate 106A is provided on the back of the freezer 103. A cold air passage 132 partitioned by a back plate 106B and communicating with the cold air passage 131 is provided on the back of the refrigerating compartment 102. The cold air passage 131 is partitioned by a partition 135 into a front portion 131A and a rear portion 131B. A cooler 111 is disposed in the rear portion 131B. The cooler 111 serving as the low temperature side of the refrigeration cycle and air circulating in the rear portion 131B exchange heat to generate cold air.

In the cold air passage 131, the axial fan 101 is disposed above the cooler 111. The axial fan 101 draws cold air from the axial direction and exhausts it in the axial direction. In the case where the axial fan 101 is the axial fan 50 according to the first embodiment, the housing 4 is inclined so that, for example, one side of the outer wall surface of the housing 4 is directed downward, and the exhaust side is directed above the refrigerator 100.

The back plate 106A has an ejection port 109A in the exhaust side in the axial direction of the axial fan 101. The back plate 106A also has an ejection port 109B below the ejection port 109A and a freezer return port 122 below the ejection port 109B.

In the case where the axial fan 101 is the axial fan 50 according to the first embodiment, a duct 133 whose channel extends toward the thin-wall portion 43 positioned above from the rotation axis C1 is disposed in the cold air passage 131. In other words, the channel of the duct 133 is inclined in the upward direction and in the lateral direction when the refrigerator 100 is viewed from the front.

In the case where the axial fan 101 is the axial fan 50 according to the first embodiment, exhaust air is directed in the axial direction (downward in the above description on the axial fan 50) in the radial center of the housing 4 and in the vicinity of the thick-wall portion 42, so that the exhaust cold air efficiently flows through the ejection port 109A into the freezer 103. The cold air exhausted by the driving of the axial fan 101 downward in the cold air passage 131 flows through the ejection port 109B into the freezer 103. The cold air that has flowed into the freezer 103 cools stored items in the storage case 170 and flows out through the freezer return port 122 back to below the cooler 111.

In the case where the axial fan 101 is the axial fan 50 according to the first embodiment, the exhaust air around the thin-wall portion 43 is discharged radially outward, so that the exhaust air flows upward along the channel of the duct 133 into the cold air passage 132. A plurality of ejection ports 108 through which the cold air is ejected are provided at the upper part of the cold air passage 132. A return air duct (not shown) is led out from the lower part of the back surface of the refrigerating compartment 102. The return air duct is connected to the lower part of the cold air passage 131. The cold air flowing out of the refrigerating compartment 102 and passing through the return air duct returns to below the cooler 111.

Since the axial fan 101 according to the present embodiment has the thick-wall portions and the thin-wall portions as described above, the cooling performance of the refrigerator 100 can be adjusted by adjusting the wind direction by the design of the thick-wall portions and the thin-wall portions.

Furthermore, since the axial fan 101 has a groove (for example, the groove 423) of the axial fan 50) at each thick-wall portion, moisture adhering to the inner wall surface of the housing can be discharged, reducing or eliminating freezing of the moisture on the inner wall surface of the housing. This is ditto for the case where the housing has no groove but has a draining hole as in the fourth embodiment.

The back plate 106A may not have the ejection port 109A but may have a protruding portion protruding toward the axial fan 101 on the exhaust side in the axial direction of the axial fan 101. For example, the protruding portion has a conical shape. The protruding portion allows the air exhausted in the axial direction to be guided in the vertical direction. In this case, the protruding portion can cause part of the exhaust air to flow back to the axial fan. Therefore, with the configuration in which one end of the groove provided at the thick-wall portion extends to the exhaust end of the housing, moisture collected in the groove is pushed back to the side opposite to the discharge side by the backflow of air, and drainage is hindered. Therefore, it is desirable not to adopt the above configuration.

As described above, the axial fan 50 according to the first embodiment of the present disclosure includes the impeller 1 that rotates about the rotation axis C1 extending in the vertical direction, the motor 2 that rotationally drives the impeller 1, and the housing 4 disposed radially outside the impeller 1 and the motor 2. In a region overlapping in the vertical direction with the impeller 1, the inner wall surface 4W2 of the housing 4 includes a first wall (a thick-wall portion) 42 having a narrow gap with the radially outer edge of the impeller 1 and a second wall (a thin-wall portion) 43 having a wide gap with the radially outer edge of the impeller 1.

This configuration decreases the gap between the impeller 1 and the inner surface of the housing 4 because of the presence of the first wall 42, thereby improving the static pressure. The static pressure can be adjusted by adjusting the ratio of the length of the first wall 42 to the length of the second wall 43 along the inner wall surface 4W2. Since the exhaust flow flows in the vertical direction around the first wall 42 and flows radially outward around the second wall 43, the direction of the exhaust flow can be adjusted.

The inner surface of the first wall 42 is part of a cylindrical shape centered on the rotation axis C1. This further decreases the gap between the first wall 42 and the impeller 1, thereby improving the static pressure. Since the gap between the inner surface of the first wall 42 and the radially outer edge of the impeller 1 in the circumferential direction is constant, a turbulent flow can be reduced, thereby reducing or eliminating generation of noise. The cylindrical shape includes a substantially cylindrical shape.

The circumferential length of the first wall 42 differs from the circumferential distance between the radially outer ends of adjacent blades 12 of the impeller 1. This prevents the adjacent blades 12 from crossing both ends of the first wall 42 at the same time, improving the noise-reduction performance.

An intake port is disposed at the upper part of the housing 4, and an exhaust port is disposed at the lower part of the housing 4. The axial fan further includes the motor base portion 3 that supports the motor 2, as well as the ribs 5 connecting the motor base portion 3 and the housing 4 together. The upper surface of each rib 5 has the inclined surface 52 that is inclined downward toward the forward end of the impeller 1 in the rotating direction. This enhances the rigidity of the, axial fan. The ribs 5 allows the air flow to be guided downward on the exhaust side.

The axial fan further includes the ring-shaped rib 6 centered on the rotation axis C1 and connected to the ribs 5.

The upper surface of the ring-shaped rib 6 includes the inclined surface 61 that is inclined downward toward the radially outside. This enhances the rigidity of the axial fan. The ring-shaped rib 6 allows the air flow to be guided radially outward.

The number of the first walls 42 and the number of the blades 12 of the impeller 1 are prime to each other. This prevents the plurality of blades 12 from crossing the first walls 42 at the same time, improving the noise-reduction performance.

All of the lengths of the plurality of the first walls 42 along the inner wall surface 4W2 are equal. This makes the static pressure distribution symmetrical about the rotation axis C1, thereby reducing or eliminating generation of a turbulent flow.

The outer wall surface of the housing 4 has a substantially rectangular shape in a cross sectional view perpendicular to the vertical direction. Both circumferential ends of the first wall 42 are provided on the inner wall surface of one side of the substantially rectangular shape. Thus, the first wall 42 is formed on the one side. This increases the radial width between the outer surface of the housing 4 and the inner surface of the first wall 42. This increases the thickness of the outer wall surface of the housing 4, thereby enhancing the rigidity of the housing 4.

The outer wall surface of the housing 4 has a substantially rectangular shape in a cross sectional view perpendicular to the vertical direction. The both circumferential ends of the first wall 42 are disposed on the inner wall surface 4W2 of different sides of the substantially rectangular shape. In other words, the first wall 42 is formed in the vicinity of each corner of the substantially rectangular housing 4. This allows the thickness of the housing 4 to be increased at the corner of the housing 4 while increasing the diameter of the impeller 1 on the inner surface of each side of the housing 4, thereby enhancing the rigidity of the housing 4.

The inner surface of the first wall 42 includes the groove 423 that is recessed radially outward and extending to an end of the housing 4 in the vertical direction. This allows moisture adhering to the inner surface of the housing 4 to be collected to the groove 423 for drainage.

The intake port is disposed at the upper part of the housing 4, and the exhaust port is disposed at the lower part of the housing 4. One end of the groove 423 is disposed adjacent to the intake port. The groove 423 decreases in depth toward the end of the housing 4 in the vertical direction. This allows moisture collected in the groove 423 to be guided to the end for drainage. This also prevents the moisture from being diffused widely far away.

The gap between the second wall 43 and the impeller 1 increases toward one end in the vertical direction. In other words, the radially inner surface of the second wall 43 is inclined radially outward toward the one end in the vertical direction. This allows moisture accumulated on the second wall 43 to be guided to the one end in the vertical direction for drainage. The radially inner surface of the second wall 43 may not be inclined but may be curved.

The refrigerator 100 according to an embodiment of the present disclosure includes the axial fan 101 with one of the above configurations. Thus allows the static pressure and the wind direction to be adjusted according to the specifications of the refrigerator 100.

The refrigerator 100 includes the duct 133. The channel of the duct 133 extends in a direction from the rotation axis C1 to the second wall 43. This allows the exhaust air to be flowed along the channel of the duct 133, allowing efficient cooling.

The reference signs assigned to the above components of the embodiments are mere examples. Any other signs can be assigned unless there is a contradiction.

The present disclosure may be used for an axial fan mounted in a refrigerator, for example.

Features of the above-described preferred embodiments and the modifications thereof may be combined appropriately as long as no conflict arises.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An axial fan comprising:

an impeller to rotate about a rotation axis extending in a vertical direction;

a motor to rotationally drive the impeller;

a housing radially outside the impeller and the motor;

an intake port provided at an upper portion of the housing in the vertical direction; and an exhaust port provided at a lower portion of the housing in the vertical direction; wherein in a region overlapping in the vertical direction with the impeller, an inner wall surface of the housing includes at least one first wall including a narrow gap with a radially outer edge of the impeller and at least one second wall including a wide gap with the radially outer edge of the impeller;

the housing includes a bottom plate at the lower portion;

an outer wall surface of the housing extends upward from the outer edge of the bottom plate and has a square or substantially square shape in a cross-sectional view perpendicular to the vertical direction;

the at least one first wall extends from the bottom plate to an upper end of the housing;

the housing includes a space provided between the at least one second wall and the impeller;

the space is defined by an empty void which extends all the way from the bottom plate to the upper end of the housing;

the at least one first wall is provided in the center of one side of the housing;

the at least one second wall includes a plurality of second walls located at positions nearer to four corners of the housing than the first wall is;

the exhaust port is a circular opening; and an inner wall surface of the at least one first wall is flush with a circumferential edge of the exhaust port such that the inner wall surface of the at least one first wall and the circumferential edge of the exhaust port overlap with each other in an axial view parallel to the vertical direction.

2. The axial fan according to claim 1, wherein the inner surface of the first wall is part of a cylindrical shape centered on the rotation axis.

3. The axial fan according to claim 2, wherein a circumferential length of the first wall differs from a circumferential distance between radially outer ends of adjacent blades of the impeller.

4. The axial fan according to claim 1, further comprising:

a motor base portion that supports the motor; and a rib connecting the motor base portion and the housing together, and wherein an upper surface of the rib includes an inclined surface that is inclined downward toward a forward end of the impeller in the rotating direction.

5. The axial fan according to claim 4, further comprising:

a ring-shaped rib centered on the rotation axis and connected to the rib, wherein an upper surface of the ring-shaped rib includes an inclined surface that is inclined downward toward radially outside.

6. The axial fan according to claim 1, wherein the number of the first walls and the number of blades of the impeller are prime to each other.

7. The axial fan according to claim 1, wherein the at least one first wall comprises a plurality of first wall, and wherein the plurality of first walls are equal in length along the inner wall surface.

8. The axial fan according to claim 1, wherein both circumferential ends of the first wall are provided on an inner wall surface of one side of the substantially rectangular shape.

9. The axial fan according to claim 1, wherein both circumferential ends of the first wall are disposed on an inner wall surface of different sides of the substantially rectangular shape.

10. The axial fan according to claim 1, wherein the inner surface of the first wall includes a groove that is recessed radially outward and extending to an end of the housing in the vertical direction.

11. The axial fan according to claim 10, wherein one end of the groove is disposed adjacent to the intake port, and wherein the groove decreases in depth toward the end of the housing in the vertical direction.

12. The axial fan according to claim 1, wherein the gap between the second wall and the impeller increases toward one end in the vertical direction.

13. A refrigerator comprising the axial fan according to claim 1.

14. The refrigerator according to claim 13, further comprising:

a duct, wherein a channel of the duct extends in a direction from the rotation axis to the second wall.

* * * * *